US005231801A

United States Patent [19]

Svetlik et al.

[11] Patent Number: 5,231,801

[45] Date of Patent: Aug. 3, 1993

[54] BELT/DISC SANDER WITH DUST PICKUP MEANS

[75] Inventors: Kenneth N. Svetlik, Schaumburg; William H. Schultz, Northbrook; Roger D. Neitzell, Park Ridge; Daniel Feldman, Highland Park, all of Ill.

[73] Assignee: Skil Corporation, Chicago, Ill.

[21] Appl. No.: 743,158

[22] Filed: Aug. 9, 1991

[51] Int. Cl.[5] ..... B24B 55/06

[52] U.S. Cl. ..... 51/273; 51/3

[58] Field of Search ..... 51/135 R, 143, 147, 51/273, 3

[56] References Cited

U.S. PATENT DOCUMENTS

| | | | |
|---|---|---|---|
| 2,089,808 | 8/1937 | Ocenasek | 51/143 |
| 2,232,149 | 2/1991 | Tautz | 51/273 |
| 2,279,782 | 4/1992 | Fowler | 51/273 |
| 2,336,004 | 12/1943 | Fowler | 51/273 |
| 4,305,231 | 12/1981 | Rasmussen | 51/3 |
| 4,924,633 | 5/1990 | Hook et al. | 51/135 R |

FOREIGN PATENT DOCUMENTS

| | | | |
|---|---|---|---|
| 0580811 | 9/1924 | France | 51/135 R |
| 0412704 | 2/1946 | Italy | 51/135 R |
| 0243163 | 12/1946 | Switzerland | 51/135 R |
| 0647853 | 12/1950 | United Kingdom | 51/135 R |

OTHER PUBLICATIONS

Hammonds' Publication, Abrasive Belt Grinders/Polishing and Buffing Lathes, Catalog 360, pp. 1-22, date unknown.

Instruction Manual on Delta Model 31-460 disc sander.

*Primary Examiner*—Roscoe V. Parker

*Attorney, Agent, or Firm*—Jones, Day, Reavis & Pogue

[57] ABSTRACT

A dust collection system for both a belt sander and a disc sander in which the dust collector for the belt sander has a removable upper section to enable a workpiece longer than the belt bed to be sanded and the disc dust collector has the front lower one-half removable therefrom to expose the entire disc for sanding. In addition, and end stop is associated with the belt sander which is formed in the shape of an elongated rectangular plate having a plurality of U-shaped orifices at the bottom thereof to form a comb-like structure that allows a greater amount of dust to enter the dust collector for the belt sander.

10 Claims, 9 Drawing Sheets

BELT/DISC SANDER WITH DUST PICKUP MEANS

FIELD OF THE INVENTION

The present invention relates to belt/disc sanders in general and in particular to belt/disc sanders that have dust pickup and collector means associated with the belt sander and with the disc sander.

BACKGROUND OF THE INVENTION

Belt/disc sanders are well known in the prior art. They have a belt table with a motor-driven shaft at one end and an idler wheel at the other. The idler wheel is adjustable towards and away from the driving shaft so that an endless loop sanding belt can be placed over the drive shaft and the idler wheel. The idler wheel is then adjusted away from the drive shaft to tighten the belt to a proper tension. On one end of the shaft driving the sanding belt is a plate which has a circular sandpaper disc placed thereon for a circular disc sander. Thus both the belt sander and the disc sander are driven by a common motor.

In the prior art, a dust collector is placed around and encompasses the end of the belt table in which the drive shaft is located. Thus the sanding belt passes into and under the cover of the dust collector and carries into it dust generated by the sanding operation. A vacuum system is connected to the essentially C-shaped dust collector which encompasses the one end of the belt and suctions the dust out of the collector. To protect the dust collector and provide support for the workpiece, an end stop is mounted to the belt bed in front of the dust collector. It is an elongated rectangular plate whose lower edge is spaced just above the sanding belt to allow the dust to pass under. The end stop supports the workpiece being sanded so that it does not engage the dust collector and damage it. The problem with this type of arrangement, of course, is twofold. First, all of the dust being generated by the sanding operation does not pass under the end stop and the end stop itself has a tendency to prevent some of the dust from entering the dust collector. In addition, if one wishes to sand a workpiece longer than the sanding belt bed, the dust collector is in the way as well as the end stop and thus prevents a long workpiece from being sanded. In addition, in the prior art, there is no dust collector associated with the disc sander.

The present invention overcomes the disadvantages of the prior art by providing a dust collector for the belt sander that is formed in two sections, an upper section and a lower section. The upper section is easily detachable from the lower section along with the end stop such that workpieces that are longer than the belt bed can be sanded with no interference from the dust collector. The lower half of the dust collector is still surrounding the lower end of the belt and is still removing dust by a vacuum system. In addition, in the present invention the end stop is formed with a plurality of spaced U-shaped orifices that extend downwardly toward the belt. The open end of the U merges with the lower edge of the elongated rectangular plate to form a comb-like structure through which greater amounts of dust can pass to the dust collector.

The lower section of the dust collector for the belt bed has its upper flat surface just below the surface of the sanding belt so that an elongated workpiece being sanded will not touch the lower section of the dust collector. The upper section has two L-shaped latching members extending downwardly from a mating flat surface which extend into orifices in the top flat surface of the lower section. A single screw attaches the upper forward end of the upper section to the end stop. Another bolt attaches the end stop to the belt bed such that the end stop can be removed by one bolt from the belt bed and the entire top section of the dust collector plus the end plate be removed simultaneously from the sander.

In addition, the present invention has a dust collector associated with the disc sander and which encompasses the entire back side of the disc sander and the lower front side so that essentially only the front upper half of the disc sander is exposed for sanding. A vacuum attachment orifice is formed in the lower front section of the dust collector so that dust generated by the disc sanding operation can be removed from the dust collector.

Thus it is an object of the present invention to provide a belt/disc sander having a dust collection system for both the belt sander and the disc sander.

It is also an object of the present invention to provide a belt/disc sander that has a dust collection system for the belt sander that is formed in two sections so that the upper section can be removed and a workpiece longer than the belt bed can be sanded since it can extend beyond either end of the belt sander.

It is yet another object of the present invention to provide a belt/disc sander in which an end stop is associated with the upper section of the dust collector and which is formed with a comb-like structure to allow a greater amount of dust generated by the sanding operation to pass into the collector.

It is still another object of the present invention to provide a belt/disc sander which has a dust collector associated with the disc sander and which collector encompasses the upper and lower rear portions of the disc sander and the lower half of the front portion, thereby enabling sanding to take place only on the upper half of the sanding disc.

SUMMARY OF THE INVENTION

Thus the present invention relates to a dust collection system for a belt sander comprising a dust collector associated with the belt sander that is formed with a removable upper section to enable a workpiece longer than the belt bed to be sanded and a dust collector associated with a disc sander which has a rear section enclosing the entire back of the disc sander and a front lower one-half which, in conjunction with the rear section, encloses the back upper half and substantially the entire lower one-half of the sanding disc.

The invention also relates to a dust collection system for a belt sander comprising a frame, a belt bed mounted to the frame for carrying an endless sanding belt that moves in a horizontal plane across the top of the bed from one end to the other end, a two-section elongated substantially U-shaped dust collector mounted to the bed so as to substantially surround the other end of the bed and sanding belt for receiving dust generated from sanding, an upper section of the dust collector being removably attached to a lower section such that by removing the upper section, a workpiece being sanded can be placed on the belt while extending beyond both ends of the bed and over the lower section, thereby enabling workpieces longer than the sander bed to be sanded, and an outlet in the lower section for attachment to a vacuum system to remove the dust.

The invention also relates to an end stop for mounting over the moving belt on the belt bed of a belt sander near one end thereof for providing a stop for a workpiece being sanded, the end stop comprising an elongated rectangular plate, a plurality of orifices formed in the rectangular plate just above the belt to allow dust generated by the moving belt to pass through the orifices in the plate, and means for attaching the plate to the belt bed for supporting a workpiece being sanded against horizontal movement.

The invention also relates to a dust collector for a disc sander comprising a frame, a motor-driven shaft, a circular plate attached to one end of the motor-driven shaft for receiving a sanding disc, a housing enclosing the entire plate except for the front upper one-half of the plate which is exposed to enable a workpiece to be sanded, and an outlet in the lower half of the housing for attachment to a vacuum system to remove the dust.

BRIEF DESCRIPTION OF THE DRAWINGS

These and other objects of the present invention will be more fully understood in conjunction with the accompanying drawings in which like numbers indicate like components and in which.

DETAILED DESCRIPTION OF THE DRAWINGS

Figure 1:
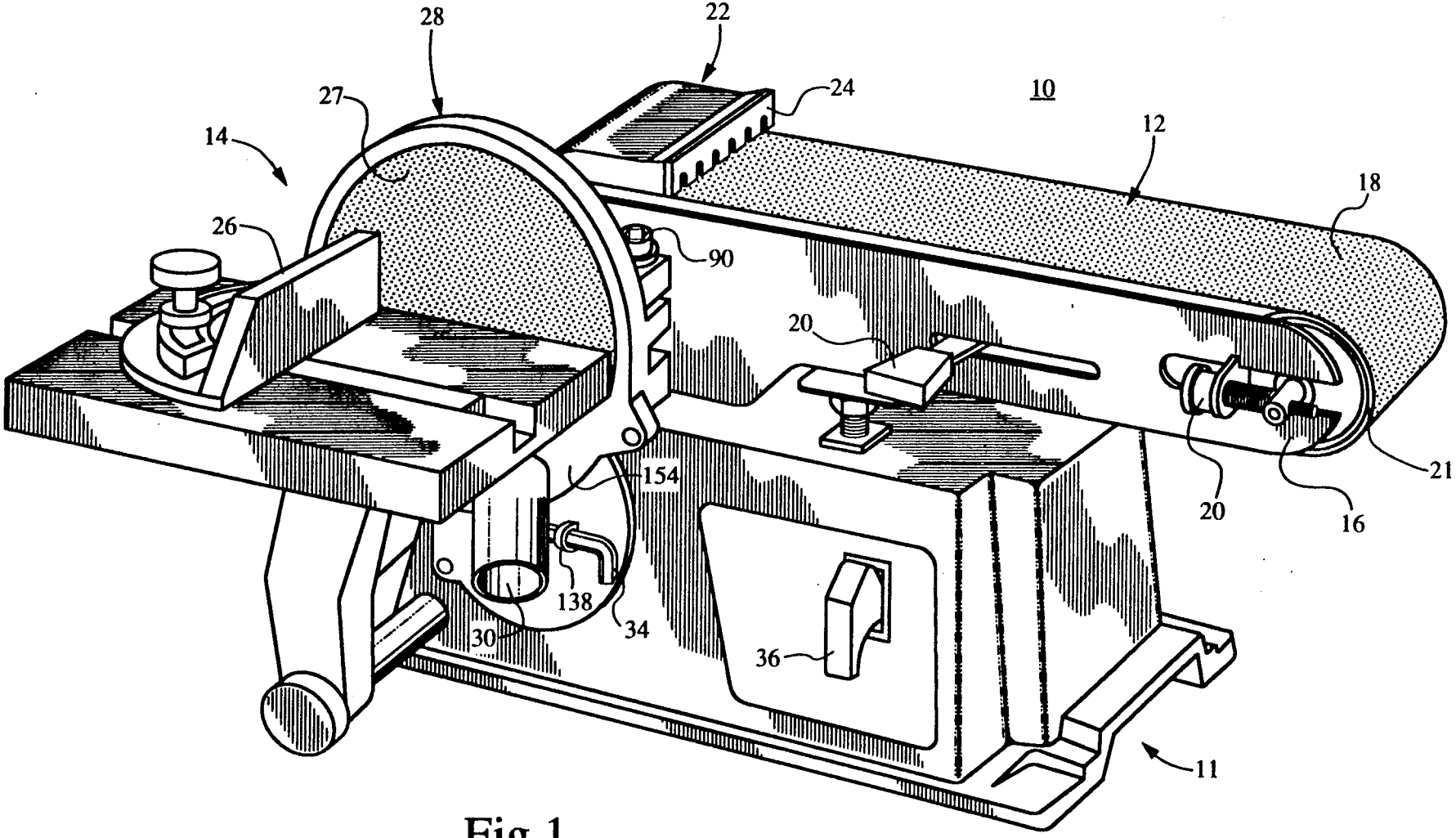
FIG. 1 is a perspective view of a belt disc sander.
Figure 2:
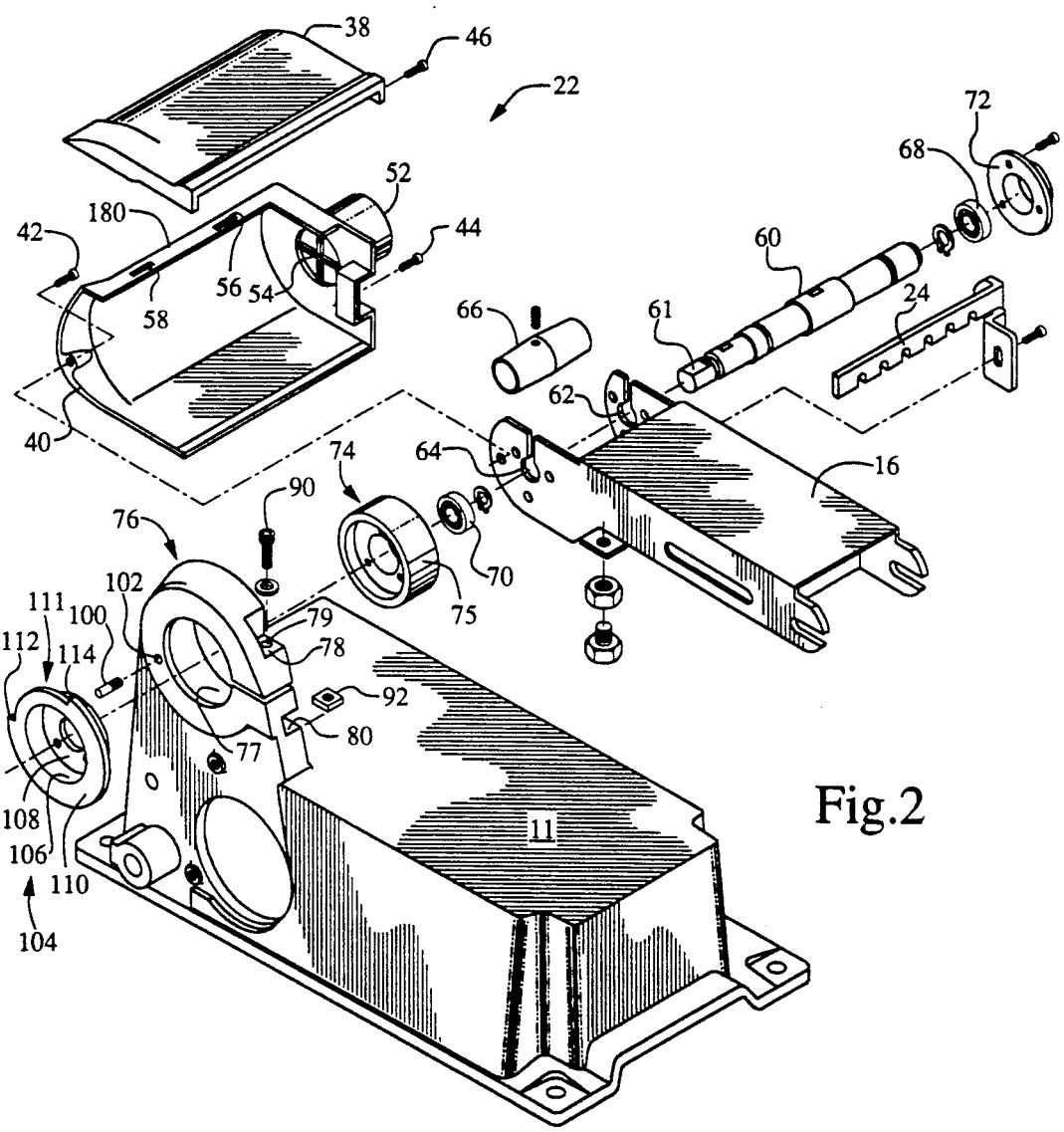
FIG. 2 is a partial exploded view of the belt disc sander illustrating the C-shaped collar and indexing pin which provides a quick release and enables the bed to be quickly moved from the horizontal to the vertical position in an accurate manner.

Referring now to FIG. 1, the novel belt/disc sander of the present invention is shown and designated generally by the numeral 10. It has a belt sander 12 and a disc sander 14. The belt sander 12 includes a belt bed 16 with an endless belt of sandpaper 18 placed thereon. An adjustment mechanism 20 allows a front idler pulley 21 to be moved inwardly sufficient to release pressure on the endless sand belt 18 to allow it to be removed and replaced as needed. A dust cover shown generally by the numeral 22 covers the drive shaft 60 as shown in FIG. 2 to collect the dust generated as the sandpaper belt 18 moves toward the dust collector 22 in FIG. 1. An end stop 24 is mounted directly in front of the dust collector 22 and is positioned slightly above the sandpaper belt 18 to allow the dust generated by the sanding operation to be carried under the stop 24 into the dust collector 22. The end stop 24 supports the items that are being sanded with the belt sander. It prevents the item being sanded from being moved along with belt 18.

In like manner, the disc sander 14 has an adjustable stop 26 which can be used to position the piece being sanded by the sandpaper disc 27. A dust cover housing 28 surrounds the sandpaper disc 27 and allows only the front portion thereof to be exposed for the purpose of the sanding operation. A vacuum attachment may be connected to orifice 30 coupled to the lower portion 154 of the dust cover 28. As will be seen later, the disc sander dust cover 28 is comprised of three portions. It has an upper back portion 184 (FIG. 13), a lower back portion 128 (FIG. 6) and a lower front portion 154 (FIG. 10) which has the orifice 30 for attachment to the vacuum system. Thus the disc 27 is surrounded on the lower half both front and back and the upper half on the back, thereby making a complete and effective dust collection system. Brackets 138–140 and 142–144 (FIG. 6) are formed on the lowest part of the lower back portion of the dust cover 28 for receiving an allen wrench 34 which will be used as described hereafter to operate a quick release to allow the belt sander bed to be moved from the horizontal position as shown to the vertical position. Switch 36 on the frame 11 turns the belt and disc sanders on and off. Both the belt sander 12 and the disc sander 14 are driven by the same drive shaft and therefore both rotate together when switch 36 is actuated.

A partially exploded schematic view of the belt sander 12 and its associated components is illustrated in FIG. 2. As can be seen in FIG. 2, belt bed 16 has orifices 62 and 64 at one end through which drive shaft 60 may be mounted. A cylindrical-type pulley 66 is mounted on shaft 60 to carry the sanding belt 18. End 61 of shaft 60 extends through bearing 70 and circular support wheel 74 which is rigidly attached to the belt bed 16 in any well-known manner such as by bolts or screws. The other end of shaft 60 is mounted in bearing 68 that fits in a recessed cup in mounting bracket 72 which is mounted to the other side of belt bed 16.

Circular support wheel 74 has a wide outer surface 75 which mates with the interior of a C-shaped clamp or collar 76 which also has a wide inner surface 77. The wide outer surface 75 of support structure 74 and the wide inner surface 77 of the C-shaped collar 76 are in mating contact. A recess 78 in the upper portion of C-shaped collar 76 has an orifice 79 therein. Recess 80 in the lower portion of C-shaped collar 76 has an orifice (not shown) that is in alignment with orifice 79. A hex bolt 90 inserted in the aligned orifices contacts nut 92 in recess 80 and can be used to compress or loosen the outer ends of C-shaped collar 76 to tighten the C-shaped collar 76 or loosen the C-shaped collar 76 about the circular support structure 74. When the belt bed 16 is in the horizontal position, the hex screw 90 can be tightened to lock the bed to the frame 11. If it is desired to raise the bed 16 to the vertical position, the hex wrench 34 on the lower front portion of the dust cover for the disc sander 14 can be used to loosen bolt 90 as a quick release and allow bed 16 to be moved to the vertical position. The bolt 90 can then be retightened and C-shaped collar 76 will engage circular support wheel 74 and lock the bed 16 in the vertical position.

An indexing pin 100 is rigidly fit in orifice 102 in C-shaped collar 76 to provide a positive stop for both the horizontal and vertical positions of the sander bed 16. An indexing plate 104 is associated with indexing pin 100 for enabling the belt sander bed 16 to be accurately positioned at the 0° and 90° positions. Plate 104 has an annular surface 106 that extends through the center of the C-shaped collar 76. A first inwardly extending flange 108 on a first end of the annular surface 106 on the inside of the C-shaped collar 76 attaches to the circular support wheel 74 which is of course attached to the belt bed 16. A second outwardly extending flange 110 on the other end of the annular fixture 106 is on the outside of the C-shaped collar 76 such that when the belt bed 16 is rotated from 0° to 90°, the second flange 110 rotates with the belt bed. An arcuate recess 111 is formed in the second flange 110 for receiving the indexing pin 100. A first shoulder 112 in the recess 111 engages the indexing pin 100 at 0° horizontal belt bed 16 position and a second shoulder 114 engages the indexing pin 100 at a 90° vertical position of the belt bed 16 so as to provide automatic stops at the correct 0° and 90° belt bed positions.

Figure 4:
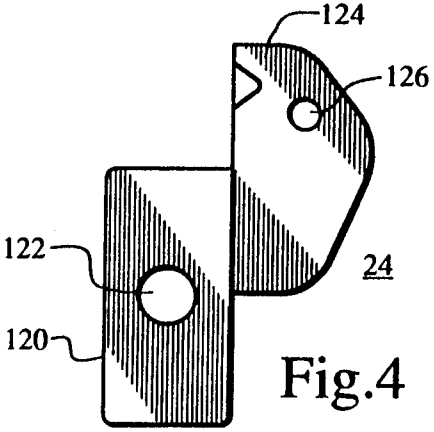
FIG. 4 is an end view of the end stop in FIG. 3.
Figure 5:
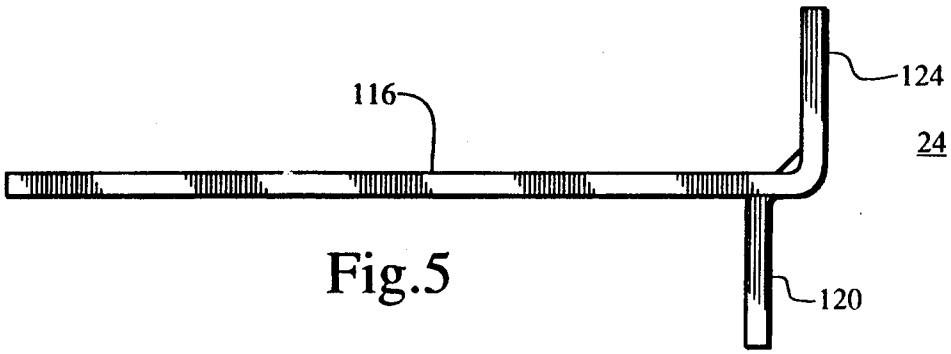
FIG. 5 is a top view of the end stop illustrated in FIG. 3.
Figure 3:
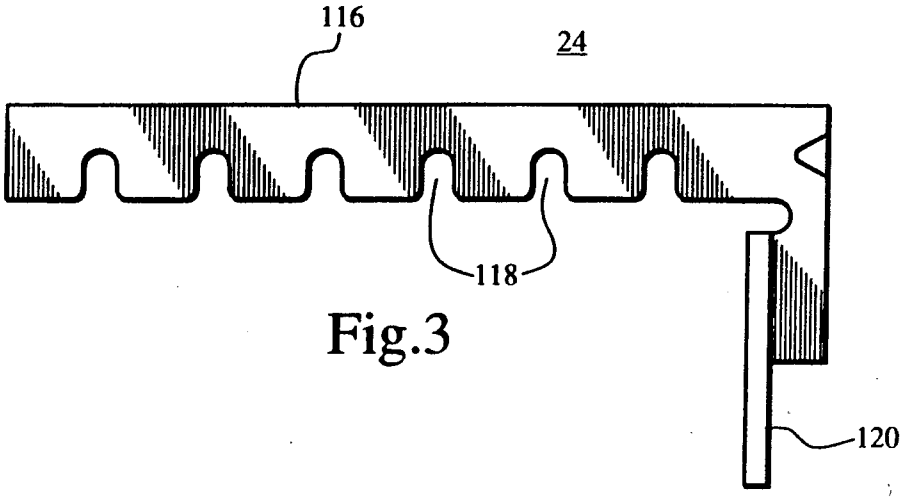
FIG. 3 is a front view of an end stop that is to be used with the belt bed.

The details of the end stop 24 are illustrated in FIGS. 3, 4 and 5. FIG. 3 is a front view of the end stop 24 which has an elongated rectangular plate 116 in which a plurality of U-shaped orifices 118 are formed. When the end stop 24 is mounted to the belt bed 16 by a bolt or screw through orifice 122 in side extension 120, the bottom surface of the rectangular plate 116 is just above the belt to allow dust generated by the moving belt to pass through the orifices 118 to the dust collector. The U-shaped orifices 118 have the open end of each U extending downwardly to the lower edge of the rectangular plate 116 thereby forming a comb-like structure. A transversely extending plate 124 extends to the rear of the rectangular plate 116 as shown in FIG. 5 and has an orifice 126 therein as shown in FIG. 4 for attaching the outer end of the upper dust collector section 38 to the end stop for support of both the upper dust collector section 38 and the rectangular plate 116.

Figure 7:
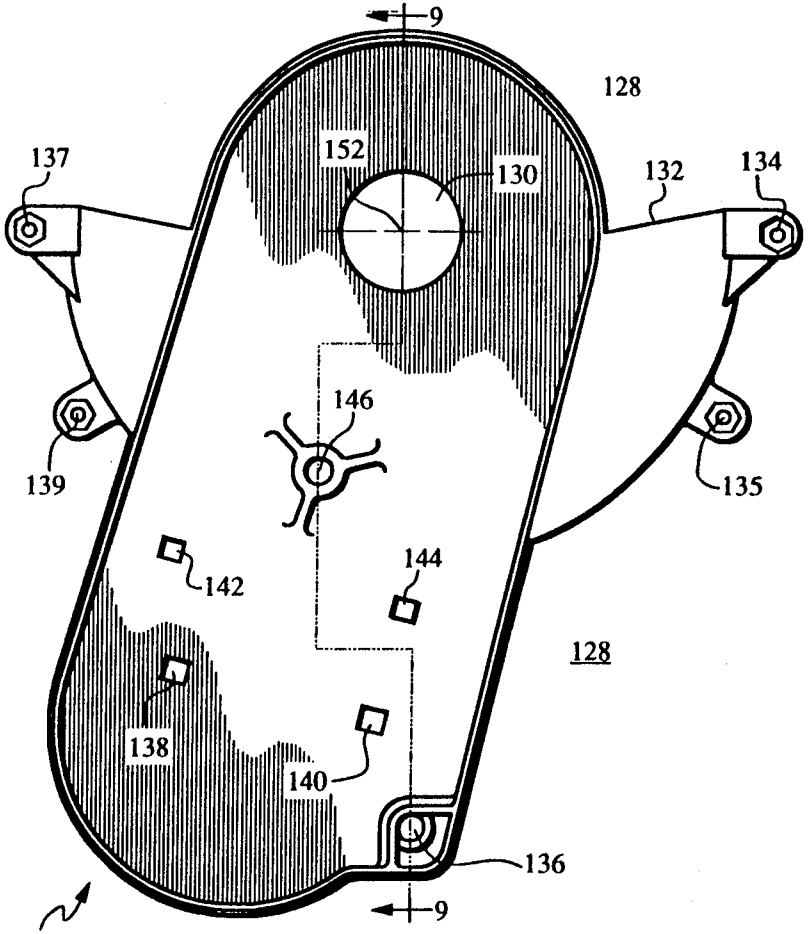
FIG. 7 is the back view of the lower rear portion of the dust collector illustrated in FIG. 6.
Figure 6:
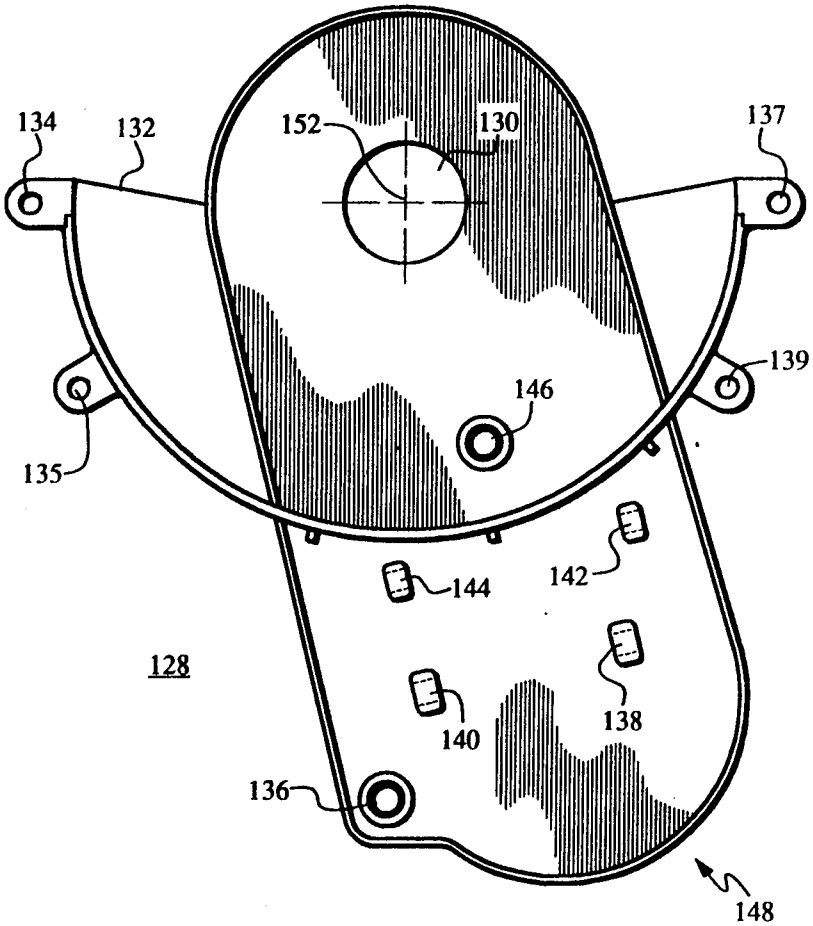
FIG. 6 is a front view of the lower rear portion of a dust collector for the disc sander on a belt/disc sander.

As stated earlier, shaft 60 that drives the sanding belt extends through C-shaped collar or clamp 76 where it is driven by a motor, not shown. The outer end of the shaft 60 also has attached thereto the disc sander 27. A dust collection system is provided for the sander 27 as illustrated in FIGS. 6–15. In FIG. 6, the lower back housing 128 is shown. It comprises a semicircular portion 132 having orifices 134, 135, 137 and 139 thereon for attachment to the top back portion and front lower portion of the dust collector. The dust is collected only in the semicircular portion 132 because the sanding disc rotates therein. The housing portion 148 below the semicircular portion 132 is on the outside of the sander and does not collect the dust. The housing 148 is integrally formed with semicircular housing portion 132 and extends downwardly therefrom. An orifice 130 is formed in the center portion of the semicircular housing portion 132 through which the end of shaft 60 protrudes with its centerline along point 152. Orifices 136 and 146 are used for bolts to attach the lower back housing 128 to the frame 11. Projections 138 and 140 are in alignment on the outside of the lower housing 148 as are projections 142 and 144. These projections have hexagonal orifices therein for receiving and retaining wrenches that can be used for the bed quick disconnect and bed adjustment bolts as partially shown in FIG. 1. FIG. 7 is a rear view of the lower rear portion 128 of the dust collector 14. All of the elements mentioned in relation to FIG. 6 can be seen from the back of unit 128 in FIG. 7.

Figure 8:
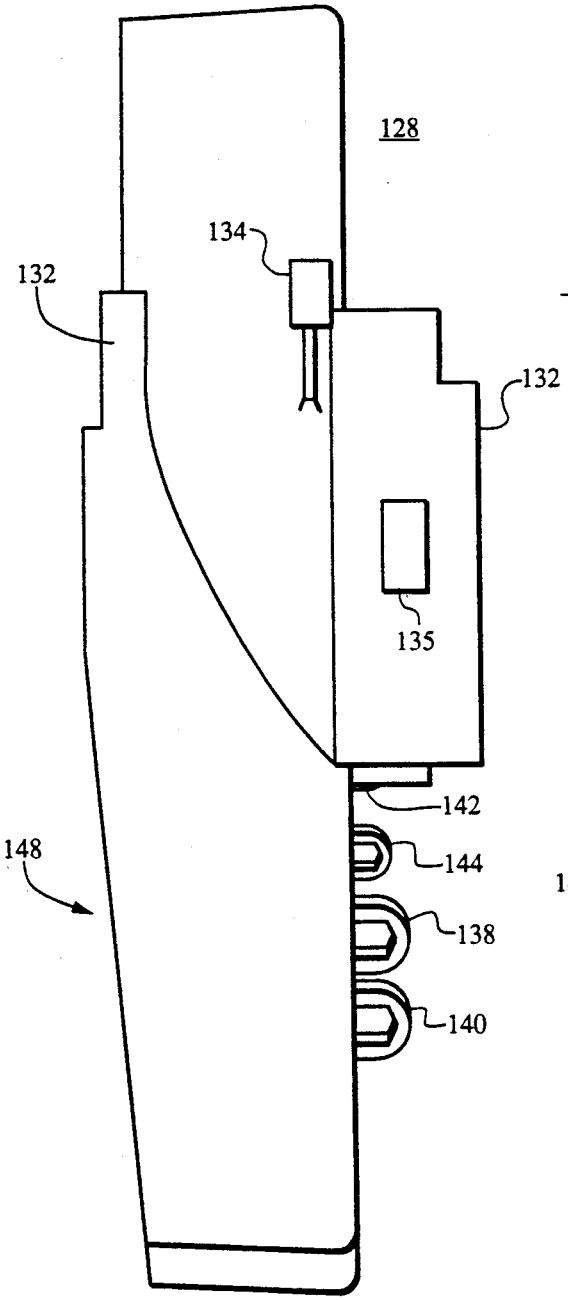
FIG. 8 is a side view of the lower rear portion of the dust collector shown in FIG. 6.
Figure 9:
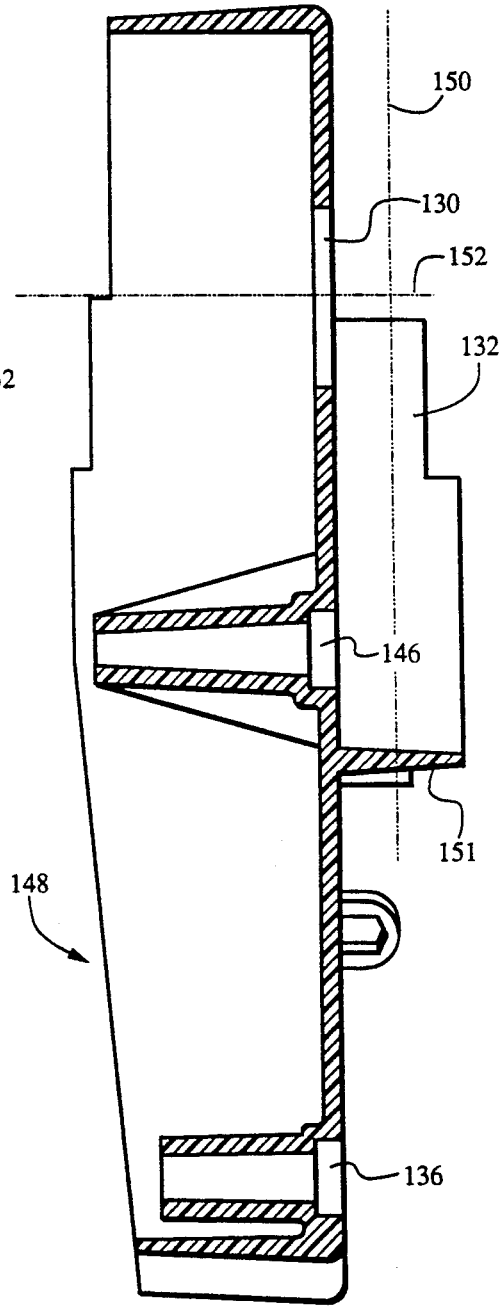
FIG. 9 is a cross-sectional view of the lower rear portion of the dust collector illustrated in FIG. 7 and taken along lines 9—9.

FIG. 8 is a side view of the lower rear portion 128 of the dust collector 14. It will be noted in the side view that the semicircular portion 132 extends in front of the extended housing 148. The sander disc 27 will rotate with the flat axis of the disc being encompassed by semicircular portion 132. FIG. 9 is a cross-sectional view of the portion 128 of the dust collector 14 taken along lines 9—9 of FIG. 7. In FIG. 9, the bolt attachment orifices 136 and 146 can be clearly seen. In addition, the semicircular portion 132 is shown clearly in front of the portion 148 where the shaft 60 would extend through orifice 130 along centerline 152. Note that the plane 150 of the rotating disc sander is encompassed within the semicircular portion 132.

Figure 10:
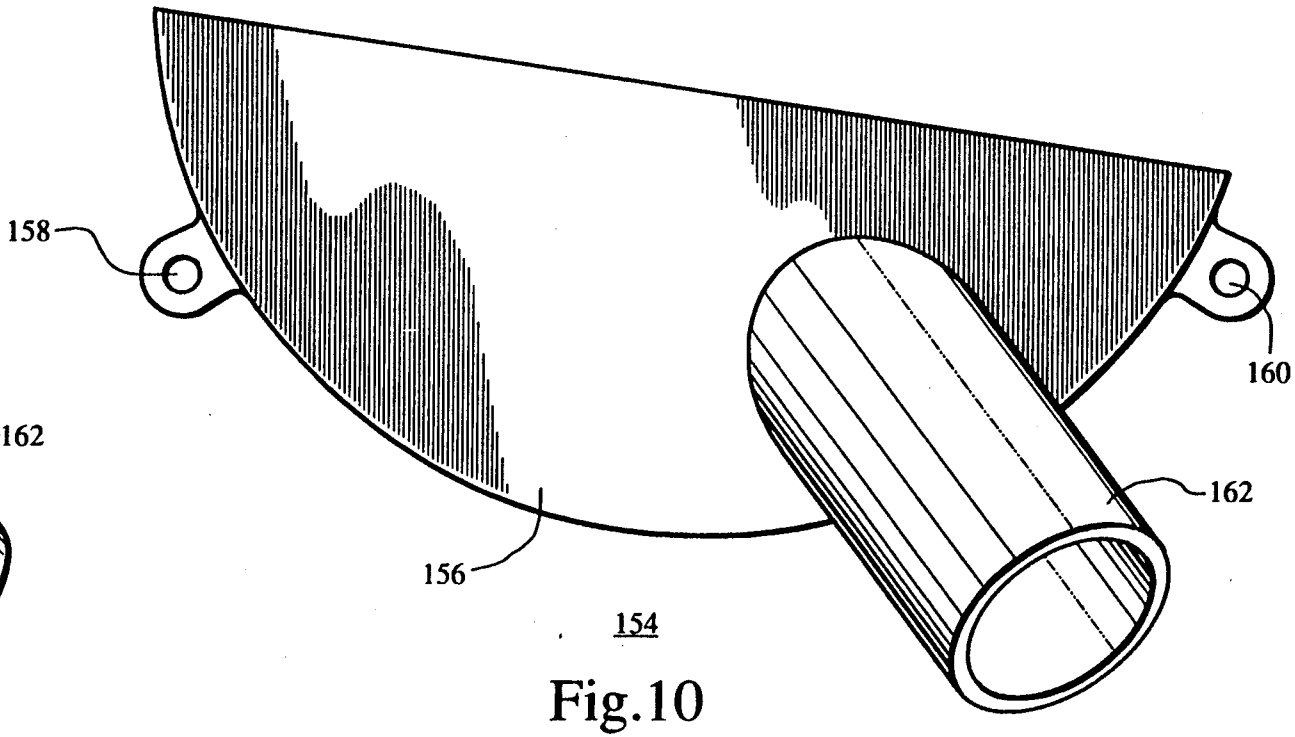
FIG. 10 is a front view of the lower front section of the dust collector for the disc sander.
Figure 11:
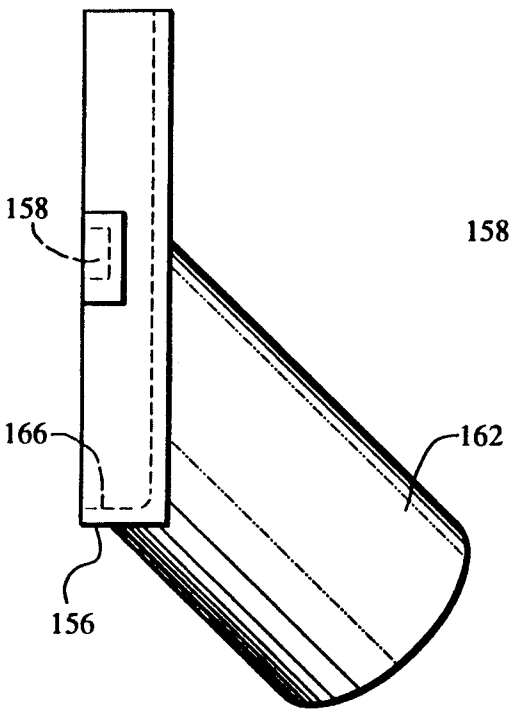
FIG. 11 is a side view of the lower front portion of the dust collector illustrated in FIG. 10.
Figure 12:
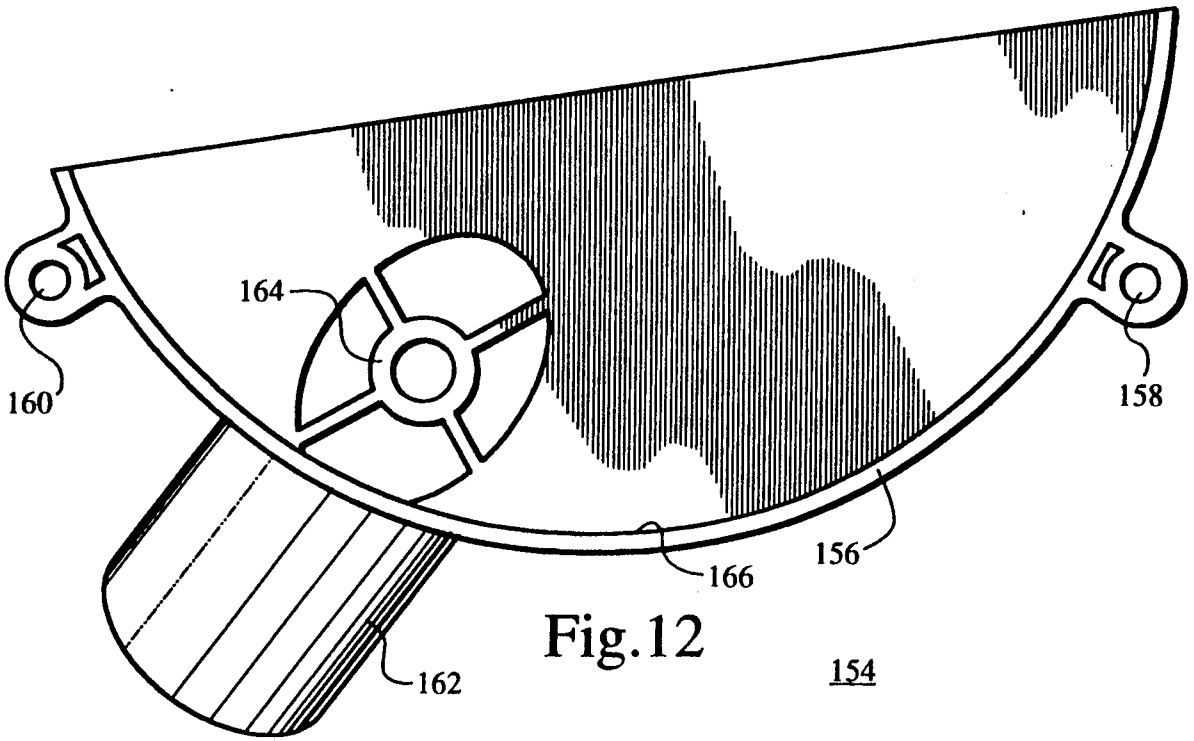
FIG. 12 is a rear view of the lower end portion of the lower front dust cover shown in FIG. 10.

The lower front portion of the dust collector 14 is shown in FIG. 10 and is indicated by the numeral 154. It can be removed, if necessary, to expose the entire disc for sanding purposes. In such case, there would be no dust collection. It has a substantially semicircular portion 156 from which a vacuum nozzle 162 extends and with which it is integrally formed. Orifices 158 and 160 allow attachment of the front lower portion 154 to the rear lower portion 128 by attachment to orifices 135 and 139 respectively as shown in FIG. 6. FIG. 11 is a side view of the lower front portion 154 of the dust collector 14. The inside shoulder 166 mates with and is under bottom surface 151 (FIG. 9) of the semicircular portion 132 of the lower rear section of the dust collector 128. FIG. 12 is a rear view of the lower front portion of the dust collector 154 illustrating the finger guard 164 that is placed in the orifice of the vacuum connection 162 to prevent one from inserting the fingers in the vacuum connection 162 and encountering the sander.

Figure 13:
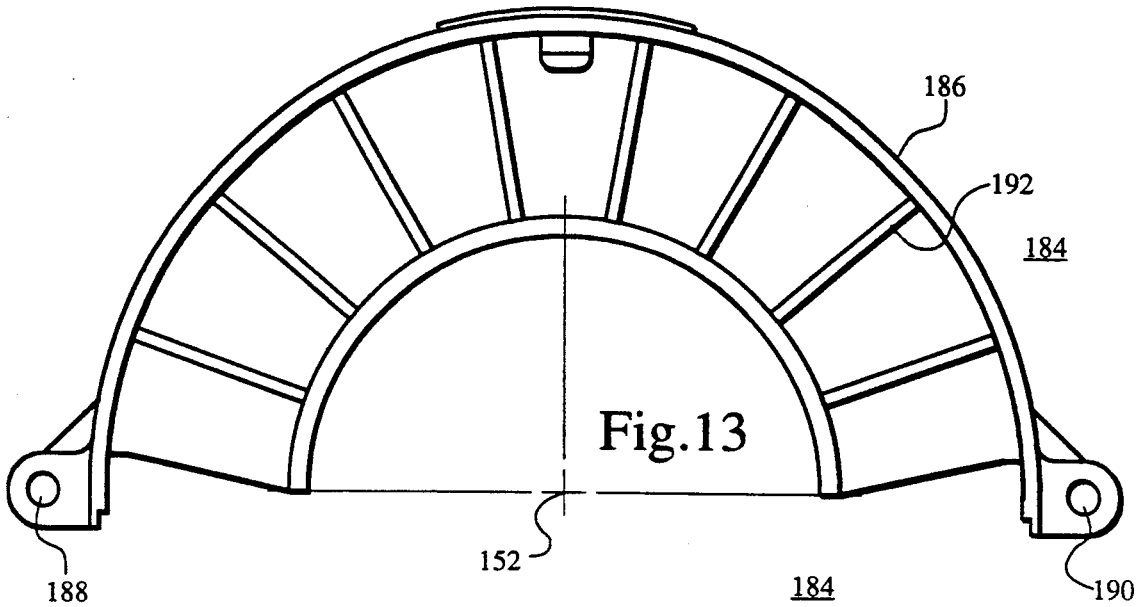
FIG. 13 is a front view of the upper section of the dust cover for the disc sander.
Figure 14:
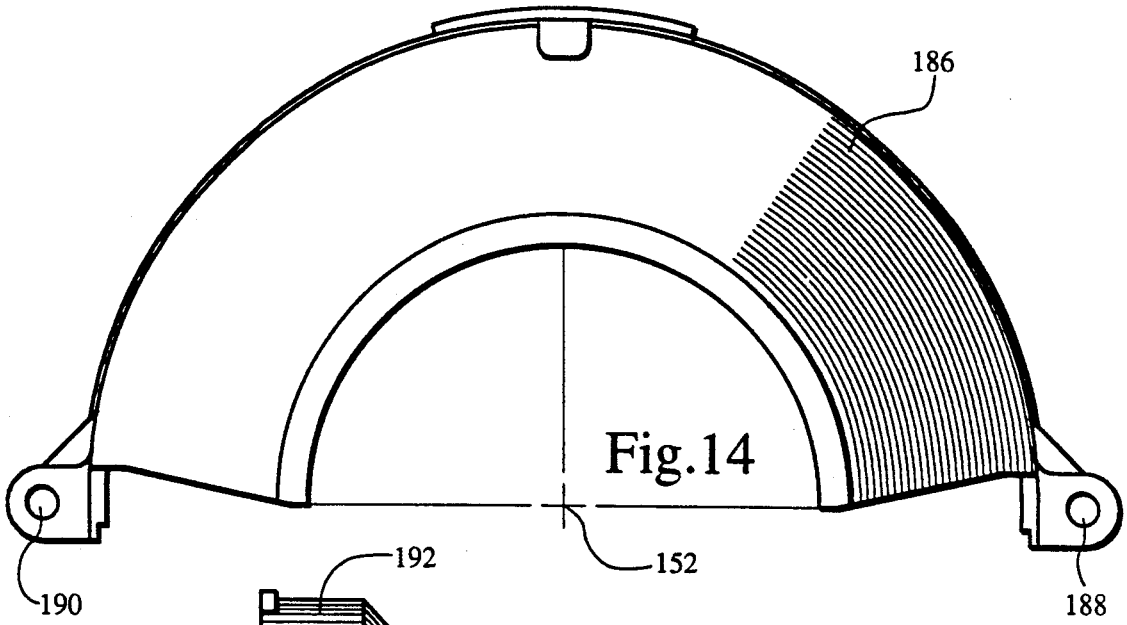
FIG. 14 is a rear view of the upper cover for the disc sander in the FIG. 13.
Figure 15:
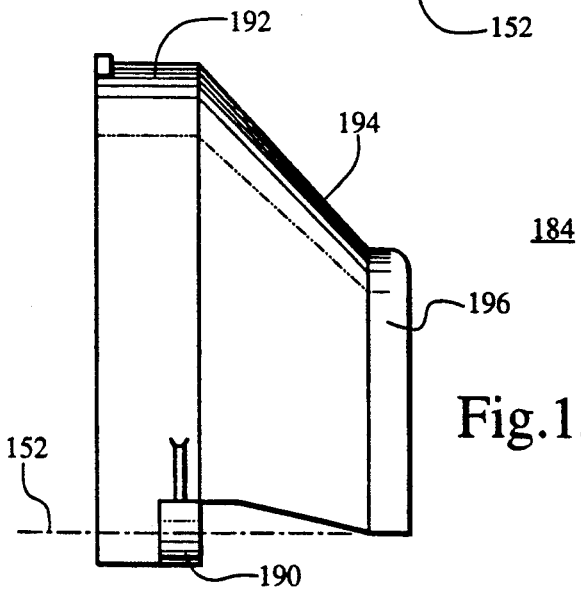
FIG. 15 is a side view of the upper section of the dust cover for the disc sander and shown in FIGS. 13 and 14.
Figure 17:
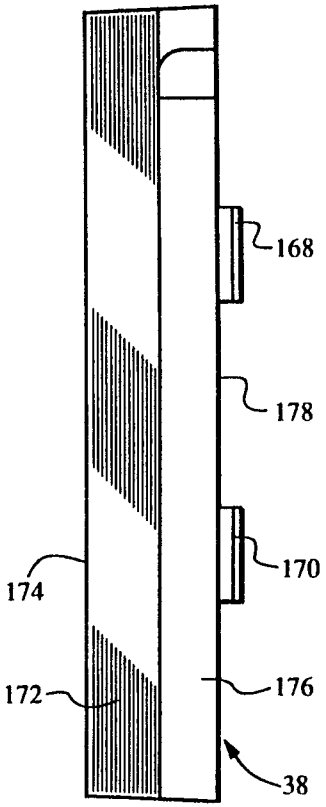
FIG. 17 is a right side view of the top portion of the sanding belt dust collector in FIG. 16.

The upper rear portion of the dust collector is designated by the numeral 184 and is shown in FIG. 13. It also may have strengthening ribs 192 and is formed with an arcuate section 186. Orifice 188 mates with orifice 134 in FIG. 6 and orifice 190 mates with orifice 137 in FIG. 6 to attach the upper rear portion to the lower rear portion of the dust collector 14. FIG. 14 is a rear view of the upper rear portion 184 of the dust collector 14. Again, the arcuate section 186 can be seen along with the orifices 188 and 190 and the centerline 152 for shaft 60. FIG. 15 is a side view of the upper rear portion 184 of the collector 14. It has a first flange section 192 which tapers downwardly at 194 to a rear section 196. The centerline 152 of the shaft 60 which drives the disc sander is illustrated.

Figure 16:
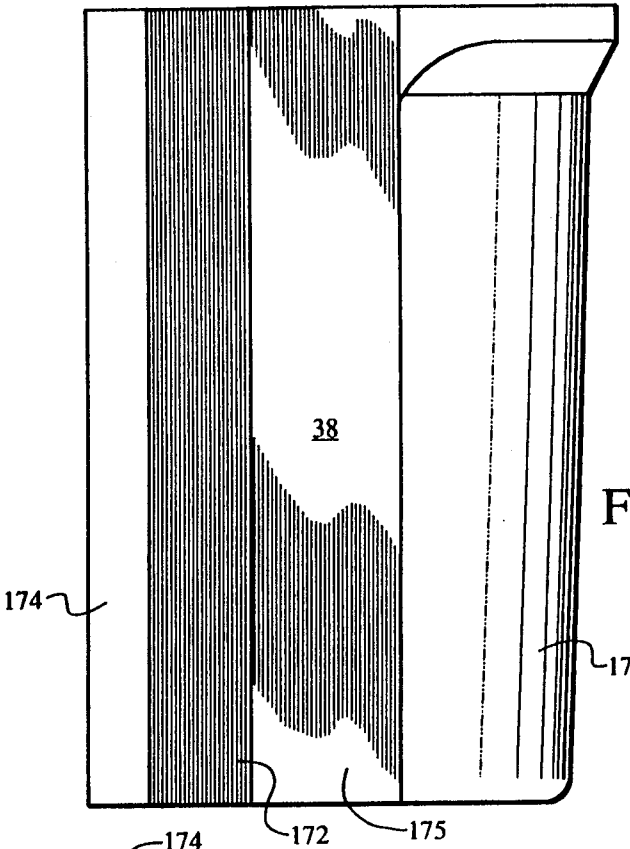
FIG. 16 is a top view of the dust cover for the belt sander dust collector.
Figure 19:
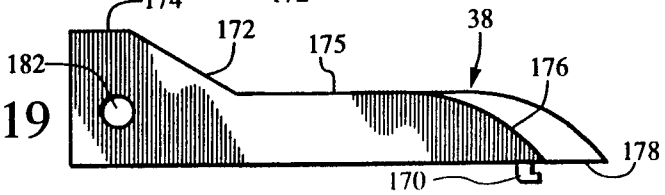
FIG. 19 is an end view of the upper section of the dust cover for the belt sander illustrated in FIG. 16.
Figure 18:
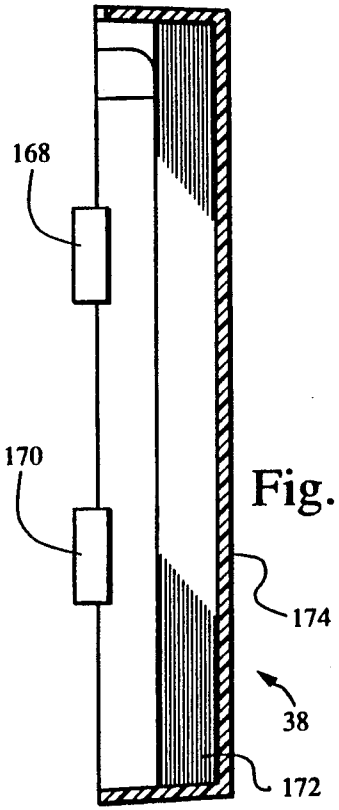
FIG. 18 is a left side view of the top section of the belt sander dust collector illustrated in FIG. 16.

FIGS. 16, 17, 18 and 19 all relate to the top section 38 of the belt sander dust collector 22. FIG. 16 is a top view of the upper section 38 which has a flat section 174 at the front thereof, a sloping surface 172 to a second flat surface 175 which tapers off in a curved surface 176 down to a flat undersurface 178 which mates with flat surface 180 on the lower portion 40 of the belt sander dust collector 22 as shown in FIG. 2. Note that the lower rear portion 176 has on the underside thereof L-shaped latching devices 168 and 170 which fit in corresponding orifices 56 and 58 of the lower section 40 as shown in FIG. 2. By removing the top section 38 of the belt dust collector 22 along with the end stop 24, an elongated workpiece that is longer than sanding belt bed 16 can be placed on the sanding belt. The user need only remove the bolt in orifice 122 (FIG. 4) that holds the top section 38 and end stop 24 to sanding belt bed 16. The end stop 24 and upper dust cover section 38 are removed by tipping them backwards until the L-shaped devices 168 and 170 are free from orifices 56 and 58. The upper surface 180 on the lower portion 40 is just below sanding belt 18 thus clearing a workpiece placed on belt 18.

Thus there has been disclosed a novel dust collection system for a belt/disc sander. A first dust collector is associated with the belt sander such that it is formed with a removable upper section to enable a workpiece longer than the belt bed to be sanded. There is also a dust collector associated with a disc sander which has a housing enclosing the entire disc plate except for the front upper one-half of the plate which is exposed to enable a workpiece to be sanded. An outlet in the front of the lower half of the housing provides attachment to a vacuum system to remove the dust. In addition, the front lower one-half of the dust collector on the disc is removable to expose the entire disc for sanding.

An end stop is also provided which is mounted immediately in front of the dust collector for the belt sander and which is formed in the shape of a comb-like structure with U-shaped orifices to allow a greater amount of dust to pass into the dust collector.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

We claim:

1. A dust collection system for a belt sander comprising:

a frame;

a belt bed mounted to said frame for carrying an endless sanding belt that moves in a horizontal plane across the top of the bed from one to the other;

a two-section, substantially U-shaped, dust collector mounted to said bed so as to substantially surround said other end of said bed and sanding belt for receiving dust generated from a sanding operation;

an upper section of said dust collector being removably attached to a lower section such that by removing said upper section, a workpiece being sanded can be placed on said belt while extending over said lower section thereby enabling a workpiece longer than said sander bed to be sanded;

said upper section being removably attached to said lower section along mating horizontal surfaces such that said horizontal surface of the lower section is adjacent but below the horizontal plane of the sanding belt thereby allowing said workpiece to be placed on said belt for sanding while extending over said lower section of said dust collector;

said horizontal surface of said lower section of said dust collector has first and second spaced elongated orifices therein;

said mating horizontal surface of said upper section having first and second spaced elongated L-shaped projections extending therefrom for insertion in the spaced orifices to hold said upper and lower sections together; and an outlet in said lower section for attachment to a vacuum system to remove said dust.

2. A dust collection system as in claim 1 further comprising a protector in said vacuum outlet to prevent an object from being inserted therein.

3. A dust collection system as in claim 2 further comprising:

an end stop mounted to said belt bed over said belt immediately in front of said upper section of said dust collector for supporting a workpiece being sanded against horizontal movement.

4. A dust collection system as in claim 3 wherein said end stop comprises:

an elongated rectangular plate;

a plurality of spaced orifices formed in said plate just above said belt to allow dust generated by said moving belt to pass through said orifices to said dust collector; and means for removably attaching the outer end of said upper dust collector section to said rectangular plate for support of both said upper dust collector system and said rectangular plate.

5. A dust collection system as in claim 3 wherein said orifices are U-shaped with the open end of each U extending downwardly to the lower end of the plate, thereby forming a comb-like structure.

6. A dust collection system as in claim 1 further including:

a drive shaft having one end extending from said belt bed, said drive shaft moving said endless belt;

a circular plate attached to said one end of said drive shaft for receiving a sanding disc;

a housing enclosing the entire plate except for the front upper one-half of the plate which is exposed to enable a workpiece to be sanded; and an outlet in the lower half of said housing for attachment to a vacuum system to remove said dust.

7. A dust collection system as in claim 6 further comprising a protector in said vacuum lower housing outlet to prevent an object from being inserted therein.

8. A dust collection system as in claim 7 wherein said outlet is a cylindrical body attached to and extending downwardly and outwardly from the lower one-half of said housing.

9. A dust collector system for a belt/disc sander comprising:

a dust collector associated with said belt sander and being formed with a removable upper section to enable a workpiece longer than the belt bed to be sanded; and a dust collector housing associated with a disc sander enclosing the entire disc sander except for the front upper one-half of the sander which is exposed to enable a workpiece to be sanded, the front lower one-half of the disc dust collector housing is removable to expose the entire disc for sanding purposes.

10. A dust collection system for a belt/disc sander as in claim 9 in which an orifice is formed in the belt sander dust collector and the disc sander dust collector for collection to a vacuum system for removing said dust.

* * * * *